US010421029B2

(12) United States Patent
Milanesi et al.

(10) Patent No.: US 10,421,029 B2
(45) Date of Patent: Sep. 24, 2019

(54) FINGER RING FOR PERFORMING A MAGIC ACT

(71) Applicants: Leonnardo Ferreira Milanesi, São Paulo (BR); Ronaldo Zanfirov Mezadri, Santo André (BR)

(72) Inventors: Leonnardo Ferreira Milanesi, São Paulo (BR); Ronaldo Zanfirov Mezadri, Santo André (BR)

( * ) Notice: Subject to any disclaimer, the term of this patent is extended or adjusted under 35 U.S.C. 154(b) by 0 days.

(21) Appl. No.: 16/145,387

(22) Filed: Sep. 28, 2018

(65) Prior Publication Data

US 2019/0091598 A1 Mar. 28, 2019

(30) Foreign Application Priority Data

Sep. 28, 2017 (BR) ..... 10 2017 020854
Sep. 18, 2018 (BR) ..... 13 2018 068930

(51) Int. Cl.
*A44C 9/00* (2006.01)
*A63H 3/14* (2006.01)
*A63J 21/00* (2006.01)

(52) U.S. Cl.
CPC ..... *A63J 21/00* (2013.01); *A44C 9/0061* (2013.01); *A44C 9/0069* (2013.01)

(58) Field of Classification Search
CPC . A44C 9/00; A63H 3/14; A63H 30/02; A63H 33/26; A63H 37/00; A63J 5/00; A63J 5/02; A63J 7/00
USPC ..... 472/57, 70, 81; 446/26; 63/15, 63/15.1–15.4, 15.45, 15.5–15.6, 15.65, 63/15.7–15.9
See application file for complete search history.

(56) References Cited

U.S. PATENT DOCUMENTS 5,558,550 A * 9/1996 Setteducati ..... A63H 37/00 446/236
6,220,916 B1 * 4/2001 Bart ..... A63H 33/00 434/393
2007/0167106 A1 * 7/2007 Hoover ..... A41F 1/002 446/26
2011/0239703 A1 * 10/2011 MacMaster ..... A44C 15/001 63/15
2013/0327088 A1 * 12/2013 Smith ..... A44C 17/0216 63/15

* cited by examiner

*Primary Examiner* — Kien T Nguyen
(74) *Attorney, Agent, or Firm* — Ohlandt, Greeley, Ruggiero & Perle, L.L.P.

(57) ABSTRACT

A ring for performing magic tricks is provided that has a miniaturized vibration motor, an on/off switch, a power supply element, a metallic contact blade, on which the power supply element is positioned, and a printed circuit board which receives wiring to interconnect the battery and the motor on the other, thereby closing the circuit.

11 Claims, 14 Drawing Sheets

(State of the Art)

SECTION BB

FINGER RING FOR PERFORMING A MAGIC ACT

CROSS-REFERENCE TO RELATED APPLICATIONS

This application claims priority under 35 U.S.C. § 119 to Brazilian Patent Application Serial No. BR1020170208540, filed on Sep. 28, 2017, and claims priority under 35 U.S.C. § 119 to Brazilian Patent Application Serial No. BR1320180689303, filed on Sep. 18, 2018, the entire contents of each of which are incorporated herein by reference.

BACKGROUND OF THE DISCLOSURE

1. Field of the Disclosure

The present patent specification specifically discloses a new finger ring for performing magic, which promotes, through a device therein, the movement of objects, especially metallic objects such as rings, nuts with screws and correlates, being particularly belonging to the field of objects and/or devices for the performance of magic and/or illusionism acts.

This finger ring, particularly developed for the performance of magic acts, has as main objective the promotion of a clean magic act and without apparent tricks, being subject to being observed closely by all who watch the magic act, as it does not use wires and, nor other apparent means for the movement of objects.

2. Description of Related Art

The present state of the art contemplates several magic acts, however the vast majority of them are performed by entertainment professionals, using the distraction technique, i.e., while preparing and executing the magic, they distract viewers' attention to another point, preventing them from observing certain movements, this fact demands a lot of manual skill, speed and precision of movements of said professionals.

Further, said magic acts present complementary elements used to justify the tricks and which, if not properly concealed, will become visible, ruining the trick's effect and beauty.

In order to provide new entertainment solutions, improving the execution of magic acts, promoting greater clarity of the acts, and properly hiding the elements that support each act, the inventor has developed a bracelet or wristband, which presents a device in its interior that promotes a vibration that, at a certain frequency, becomes capable of moving certain objects, turning them without the spectators noticing how this occurs.

The constructive scheme of this bracelet/wristband belonging to the state of the art can be seen through FIG. 1 of this specification and in a later description.

In the hands of a magic professional, a given object starts to move around without wires, no magnets, no magnetics, no coils, no rubber bands, nothing connected to the object, nothing hidden in his hands and without changing the objects when show the said object to the spectators.

It turns out that, nowadays, the smaller the elements are and additionally, the less apparent and likely to be discovered they are, the better it is in order for the magic to be as realistic as possible.

The existing device for performing the trick of moving objects without hands, or any apparatus which assists it, is of a large size, since it provides a shape of a bracelet or a wristband, the scheme of which will be shown in FIG. 1 and described later.

In order to use said device, there is a need for external electrical wiring to be triggered, thus requiring the need to wear long sleeved shirts, covering the arms so that it is not possible to identify the wiring and, consequently, the device that promotes the movement of objects.

SUMMARY OF THE DISCLOSURE

One of the purposes of this ring for performing magic acts is its application to an object of minute dimensions, specially developed to receive a device which, when actuated, makes the execution of the magic act more realistic, being the ring an element of substantially smaller dimensions than a bracelet or a wristband, an usual adornment element or fashion accessory.

Another important object of this application lies in substantially reducing the size of its components, i.e., all of its electronic components, as well as the battery of the device applied to the ring, are miniaturized.

Another important object of this ring for performing magic acts is to entirely eliminate the existence of external wiring, fact that allows the professional and/or performer of magic to wear t-shirts or short-sleeved shirts and/or shorts during the presentation of magic.

In this way, removing the bracelet or wristband and all its wiring was a strong need and presenting with bare arms and clean hands have become essential procedures so that a magic trick could really draw the curiosity of the spectators to knowing how the trick was done, making the performance of the professional better and more accurate in the execution of the magic trick, making it appear real.

In more advanced studies of this subject, this same applicant, in order to promote an even smaller device with a simplified and differentiated construction of the others existing in the state of the art, has created and developed this finger ring, which aims at this time to present a ring with a new and small construction, of even smaller dimensions, performing exactly the same function as the bracelet, wristband or other object of similar dimensions, without the use of apparent and/or external wires that can be hidden by the magician/illusionist.

Thus, the present finger ring for performing magic acts and/or illusionism is presented through a finger ring, providing conventional external appearance, yet having, internally, a device positioned in cavities where a set of electronic components, whose intrinsic function, when in operation, is to produce a mechanical vibration at a certain frequency, which is capable of providing the user with the realization of various visual effects of magic and/or illusionism on certain objects, by moving them, is installed.

The category of effects that can be performed with the proposed magic ring is known as "telekinesis", a term that by definition consists of moving objects with the force of thought.

The trick occurs through the mechanical vibration of the ring motor, which allows the magician/illusionist to reproduce the visual effect of "telekinesis" without the viewer identifying the technique or method used for it, since the vibration produced only can be perceived by touch, being hardly identified visually or through hearing.

Certain objects (depending on their size, shape and weight) upon contact with the mechanical vibration produced by the device will move, apparently without the intervention of physical means, thus consolidating the illusion of the occurrence of "telekinesis".

BRIEF DESCRIPTION OF THE DRAWINGS

The subject matter of this disclosure will be entirely clear in its technical aspects from the detailed description which will be made on the basis of the following figures, in which.

DETAILED DESCRIPTION OF THE DISCLOSURE

Figure 1:
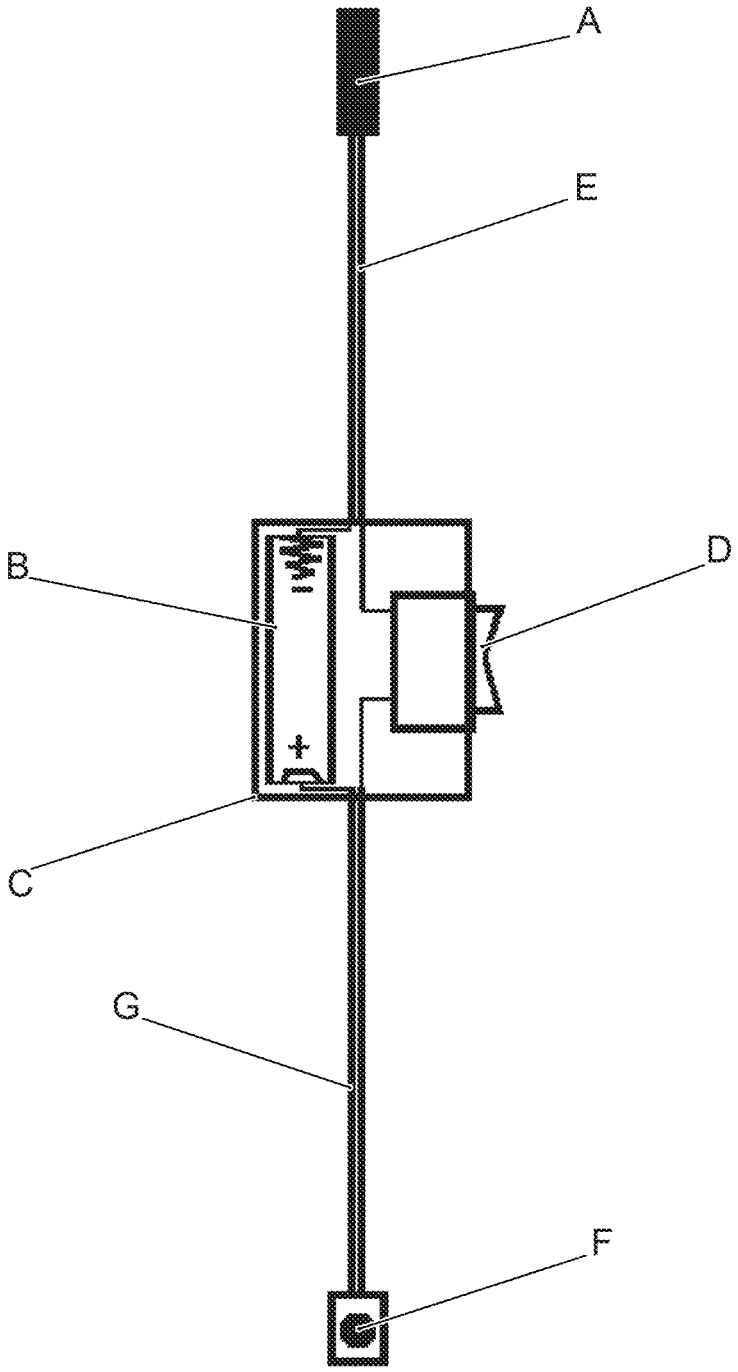
FIG. 1 shows the constructive scheme of the bracelet/wristband belonging to the state of the art.
Figure 2:
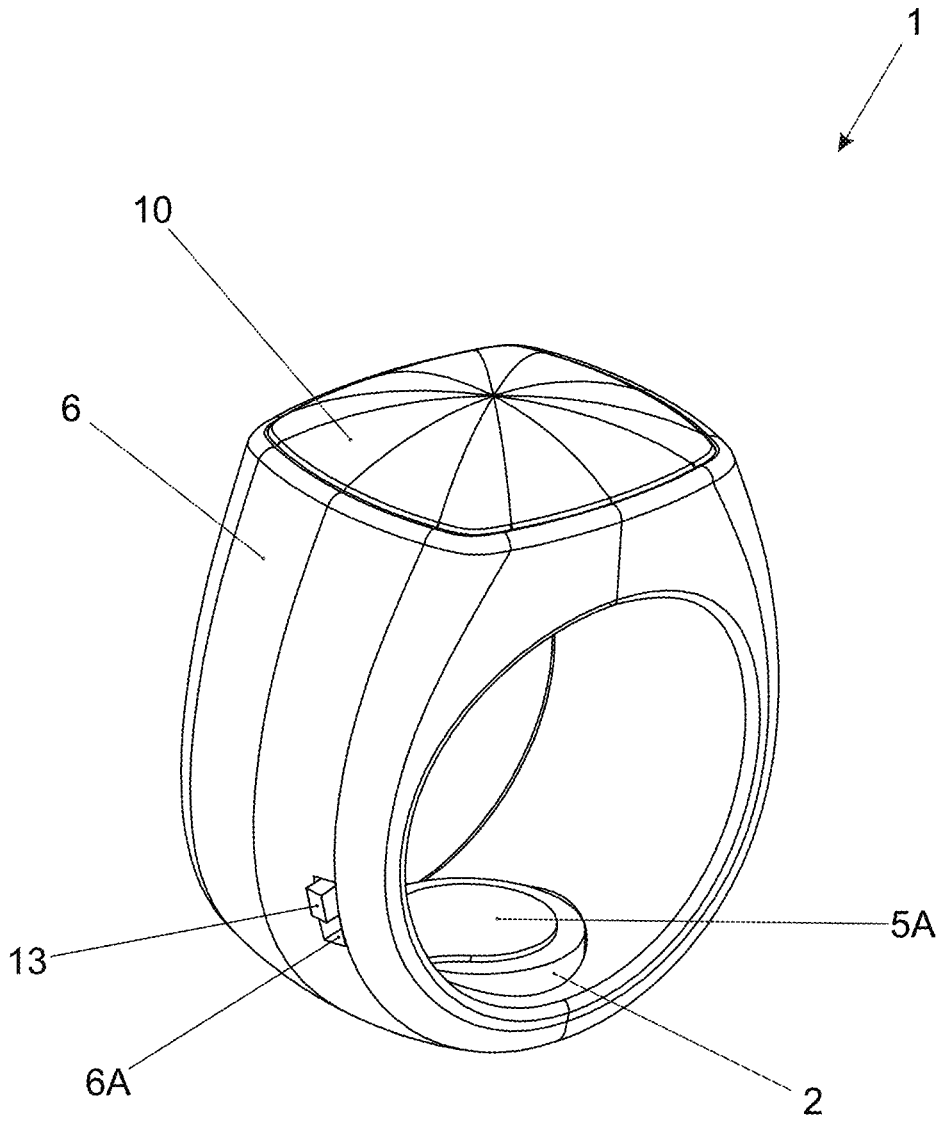
FIG. 2 shows a right perspective view of the finger ring for performing a magic act.
Figure 3:
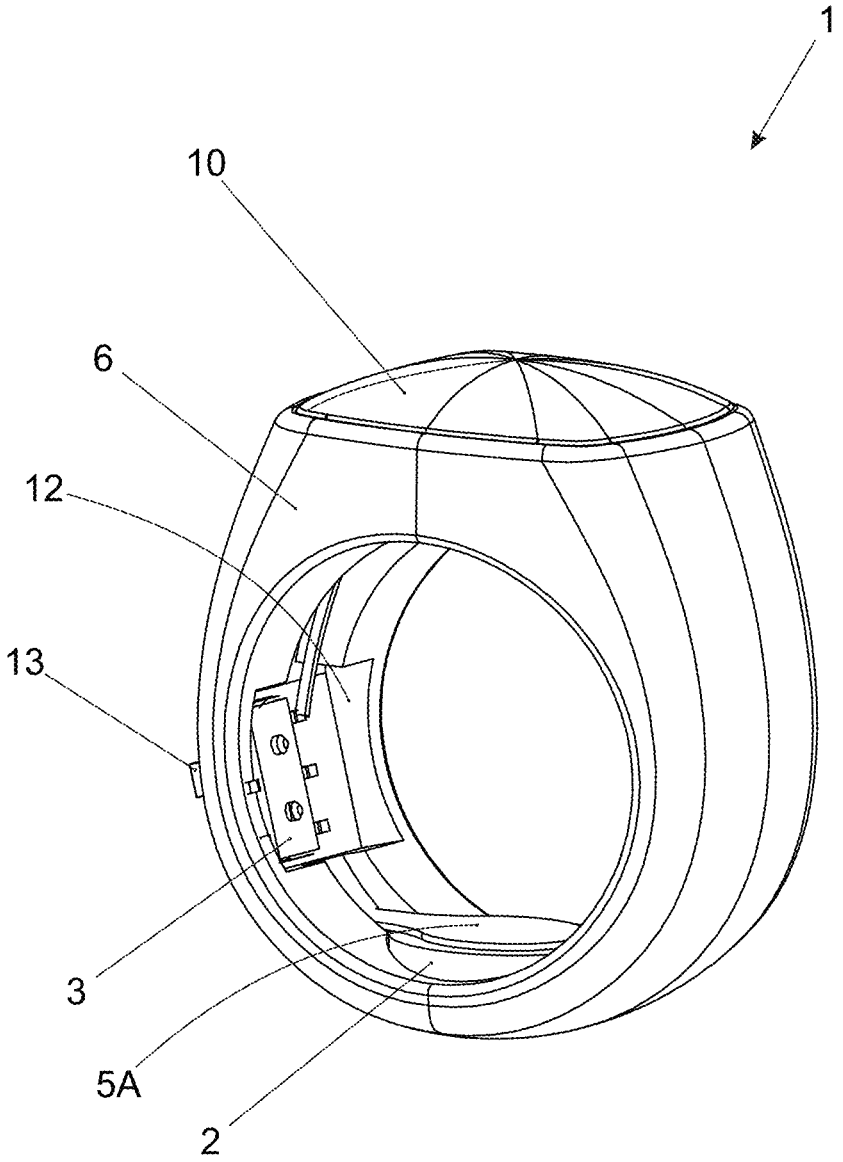
FIG. 3 shows a left perspective view of the finger ring for performing a magic act.
Figure 4:
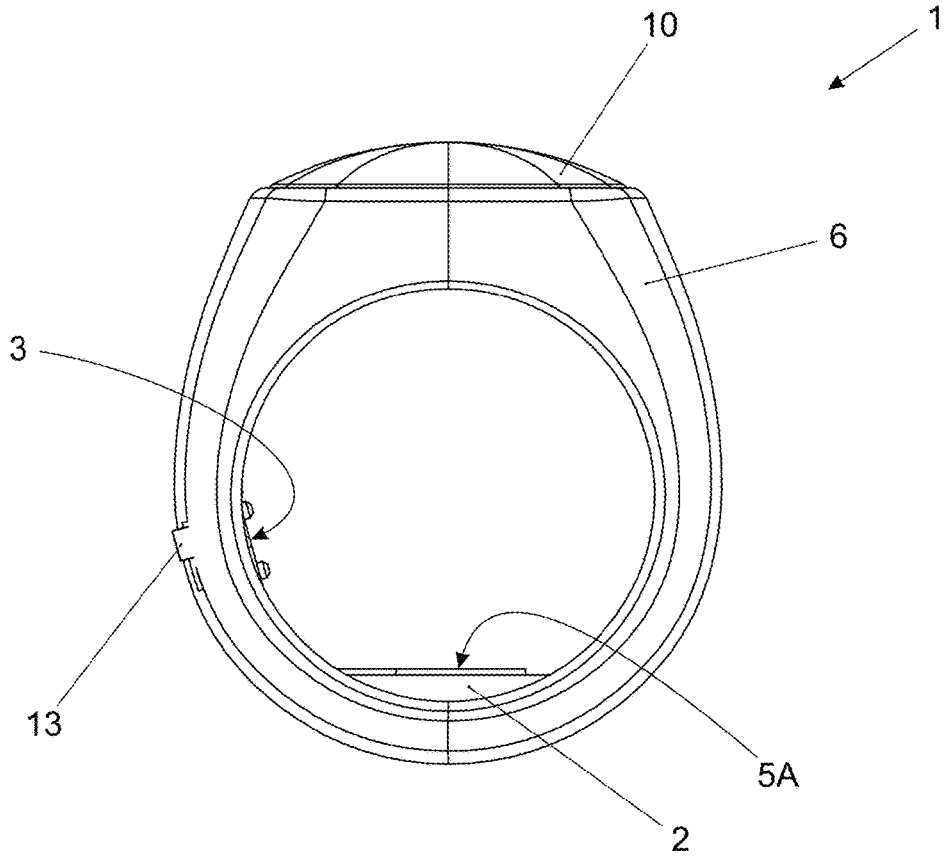
FIG. 4 shows a front view of the finger ring for performing a magic act.
Figure 5:
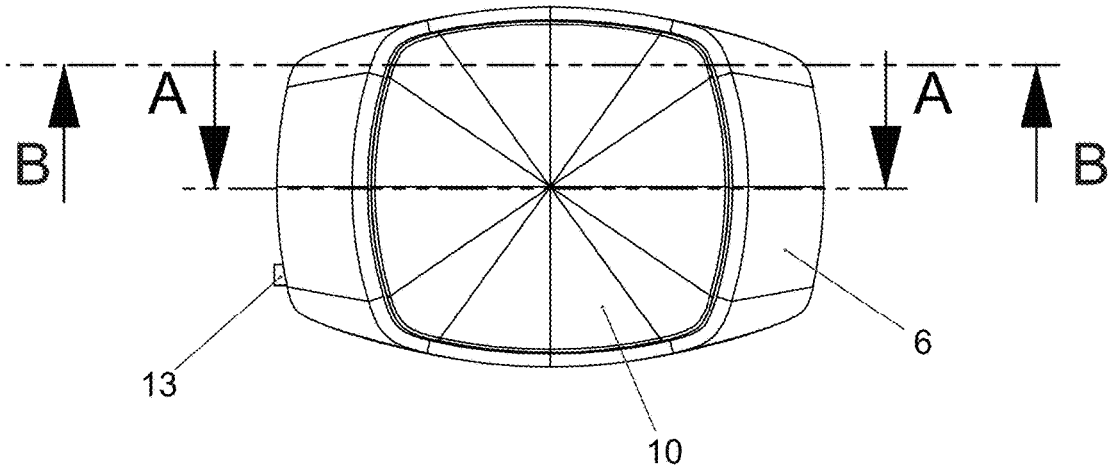
FIG. 5 shows a top view illustrating the indications (A-A) and (D-D) of the cuts performed on the finger ring for performing a magic act.
Figure 6:
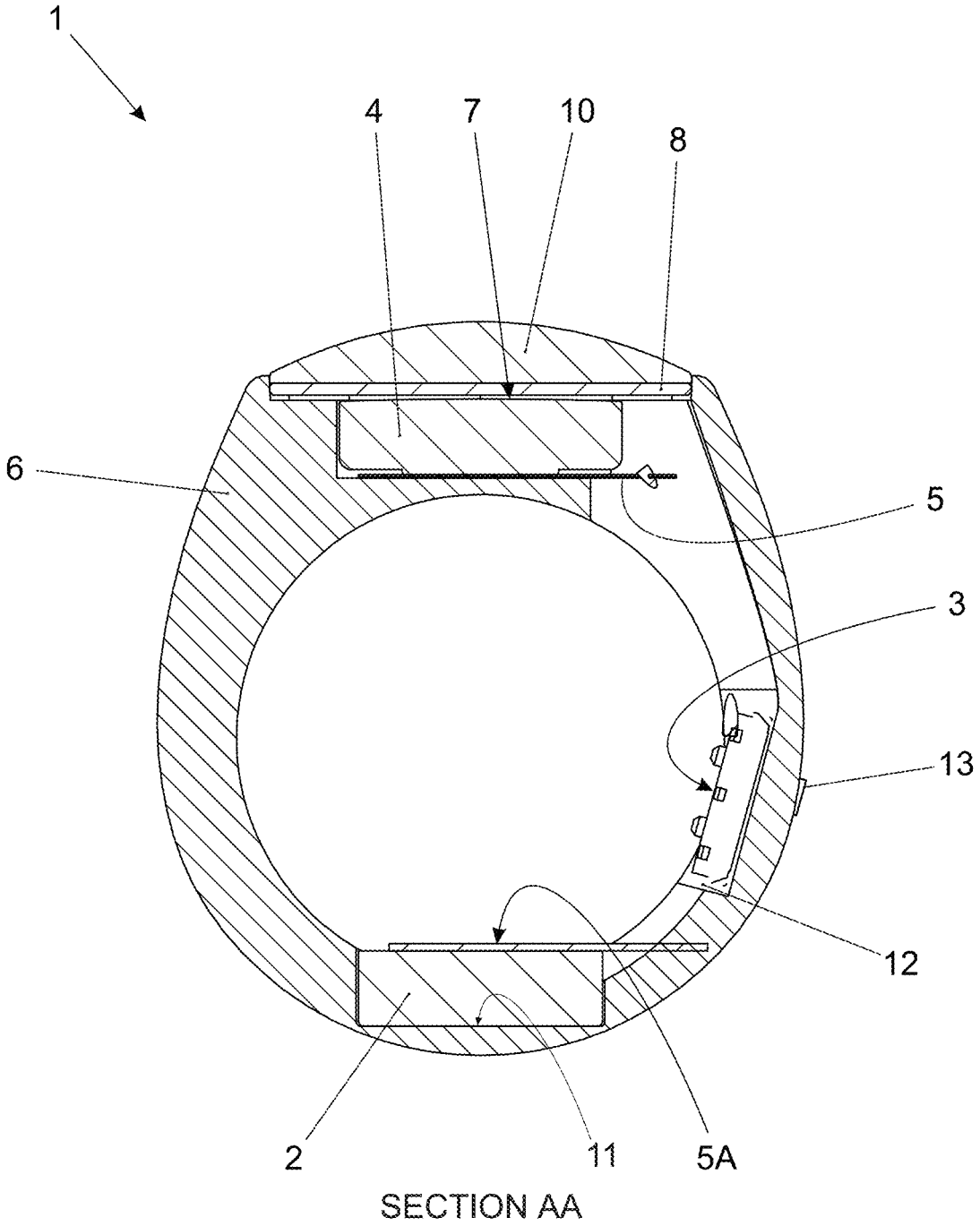
FIG. 6 shows a front-cut (A-A) view of the finger ring for performing a magic act.
Figure 7:
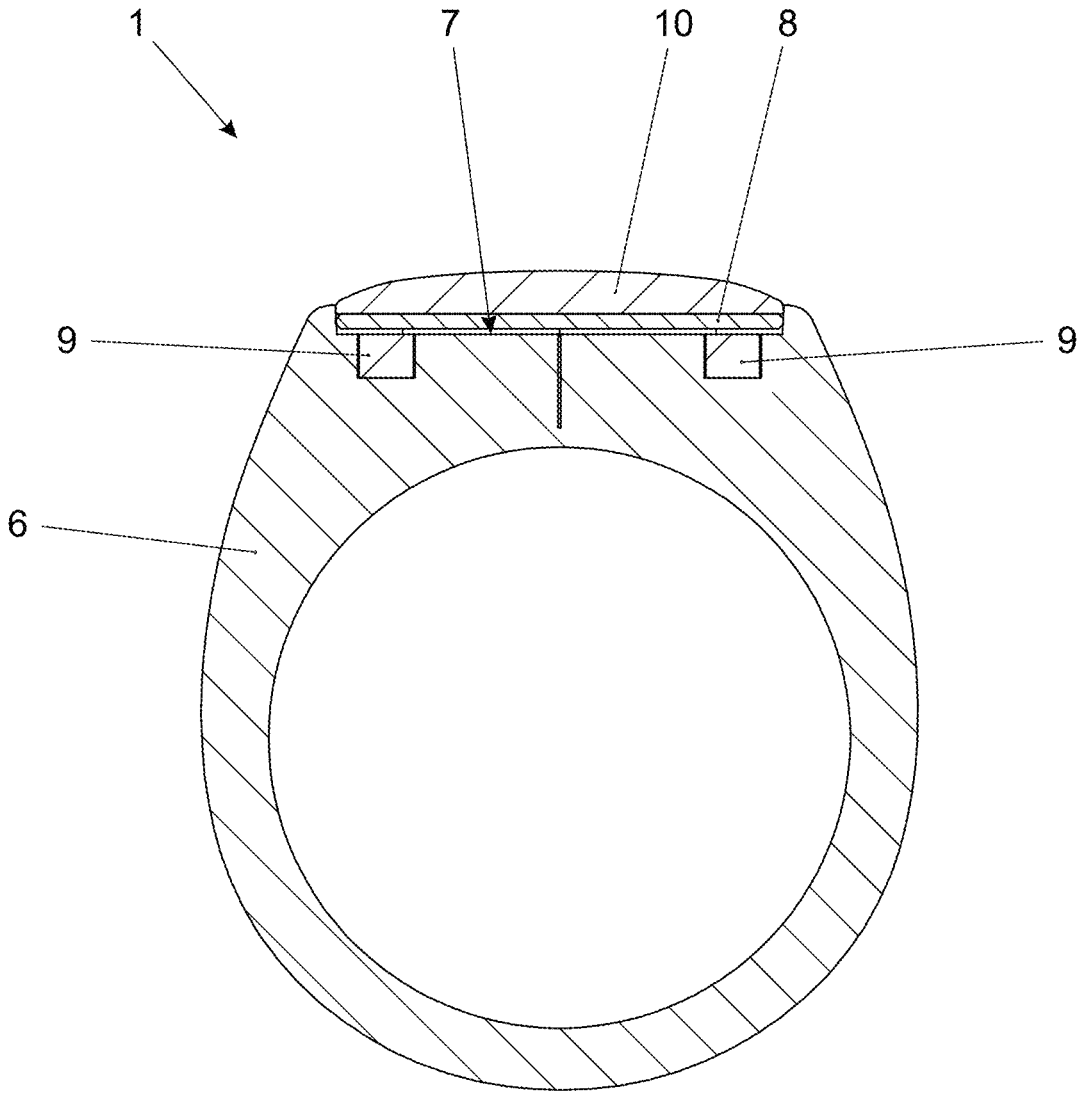
FIG. 7 shows a front-cut (D-D) view of the finger ring for performing a magic act.
Figure 8:
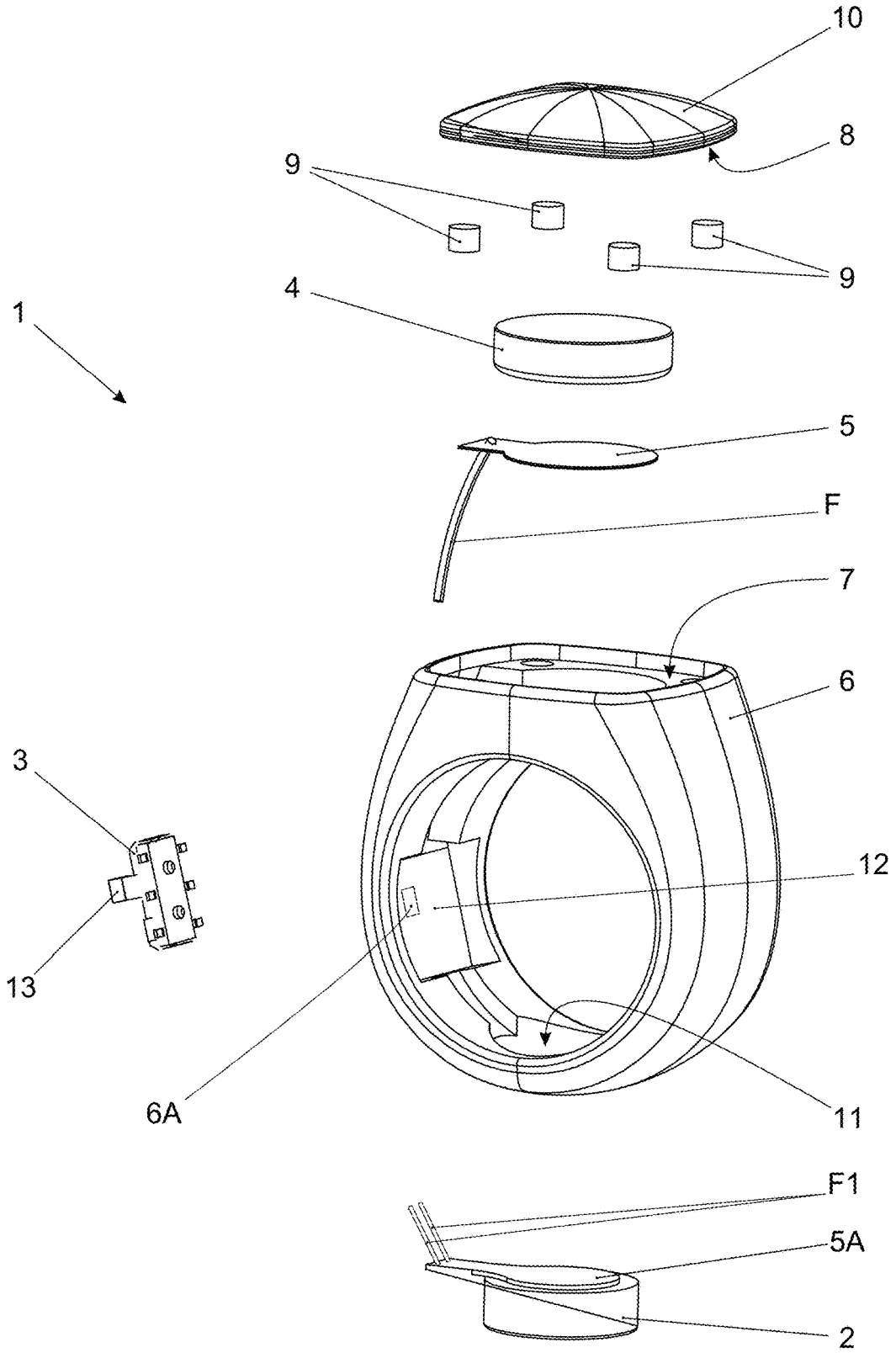
FIG. 8 shows a left front exploded perspective view of the finger ring for performing a magic act.
Figure 9:
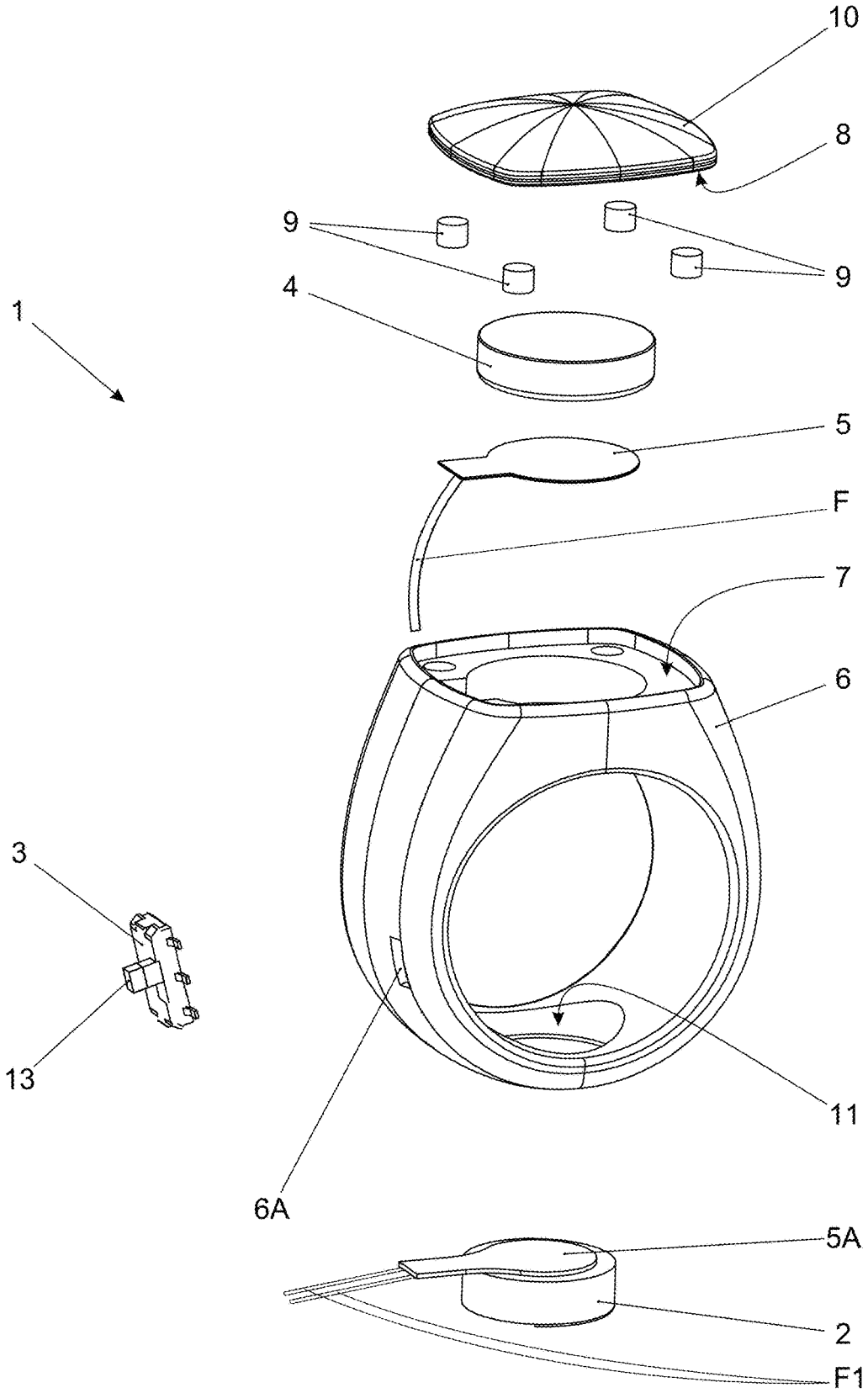
FIG. 9 shows a right front exploded perspective view of the finger ring for performing a magic act.
Figure 10:
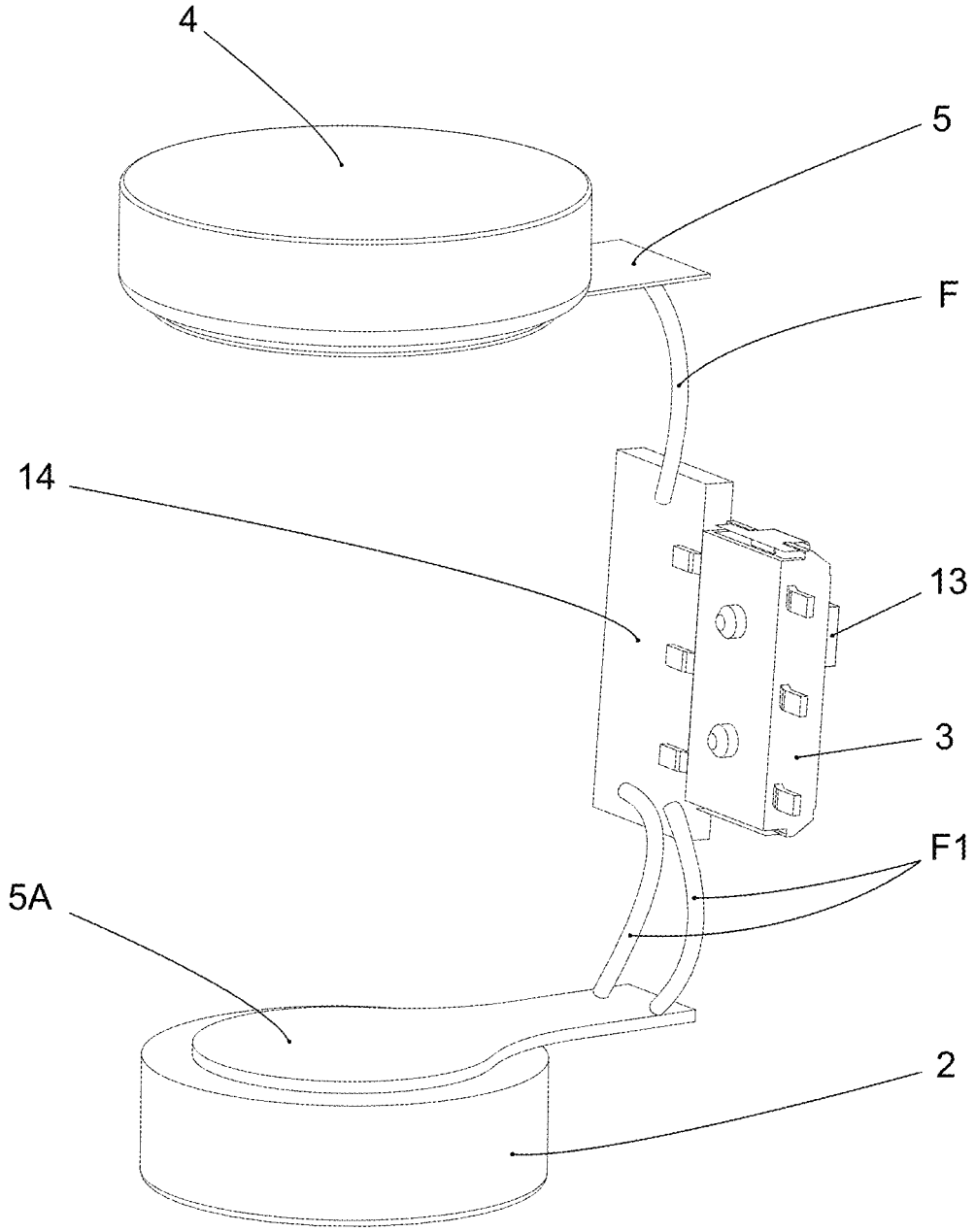
FIG. 10 illustrates a perspective view of the device designed to be applied to the magic ring.
Figure 11:
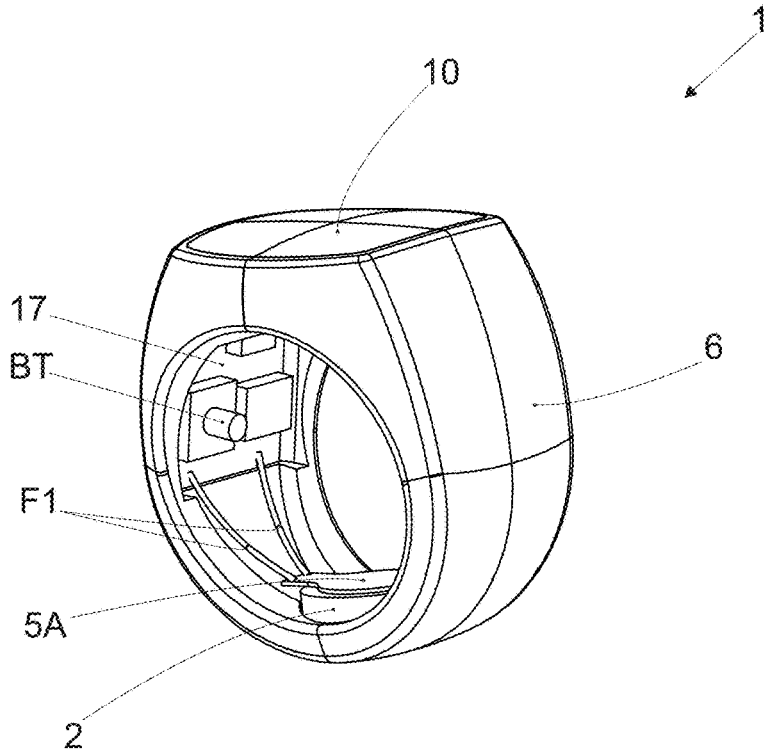
FIG. 11 shows a perspective view of an embodiment of the ring now treated.
Figure 12:
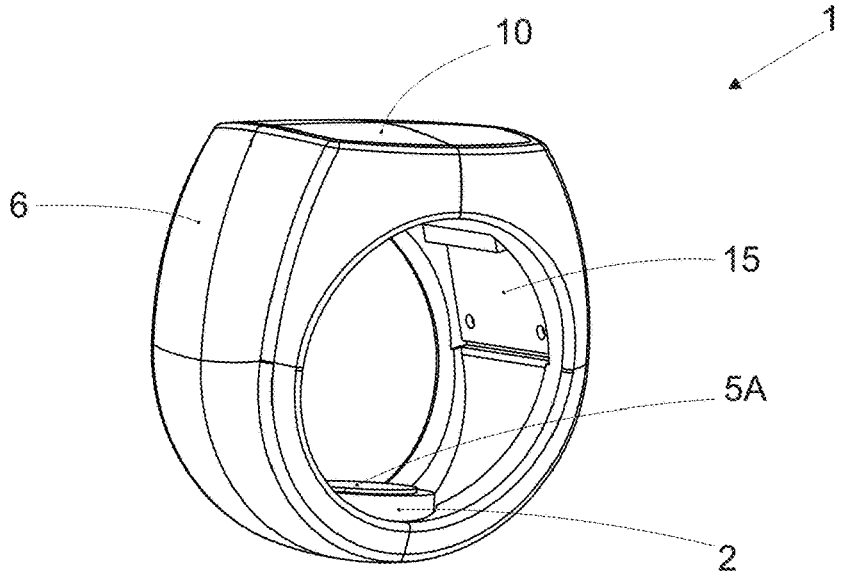
FIG. 12 shows another perspective view of the embodiment of the ring now treated.
Figure 13:
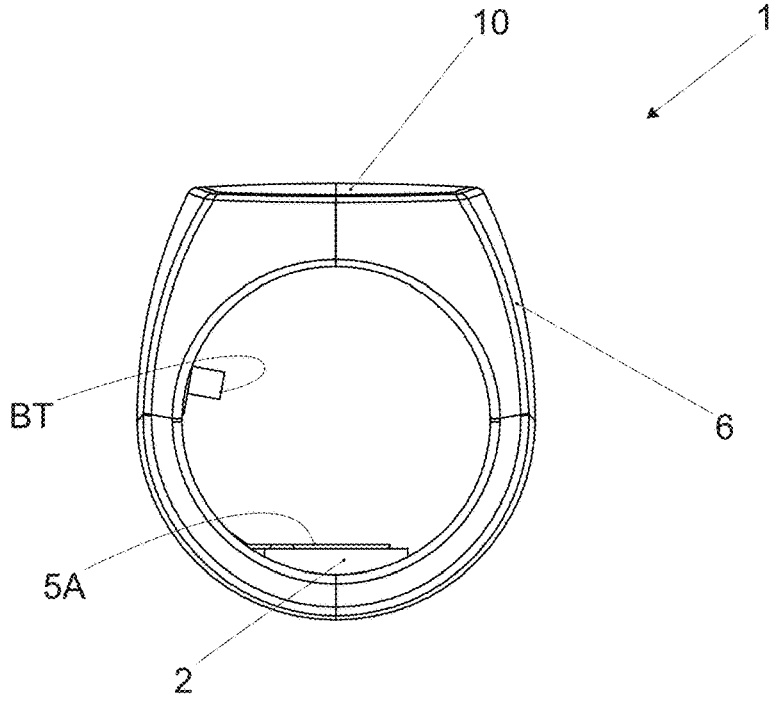
FIG. 13 shows a front view of the embodiment of the ring shown in FIGS. 11 and 12.
Figure 14:
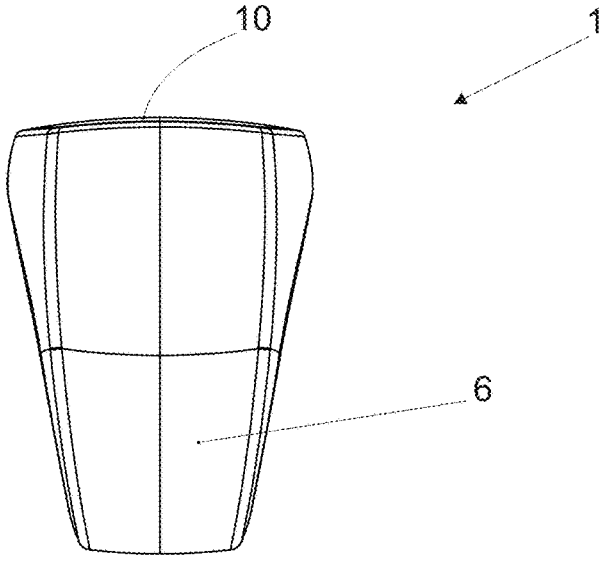
FIG. 14 shows a side view of the embodiment of the ring shown in FIGS. 11, 12 and 13.
Figure 15:
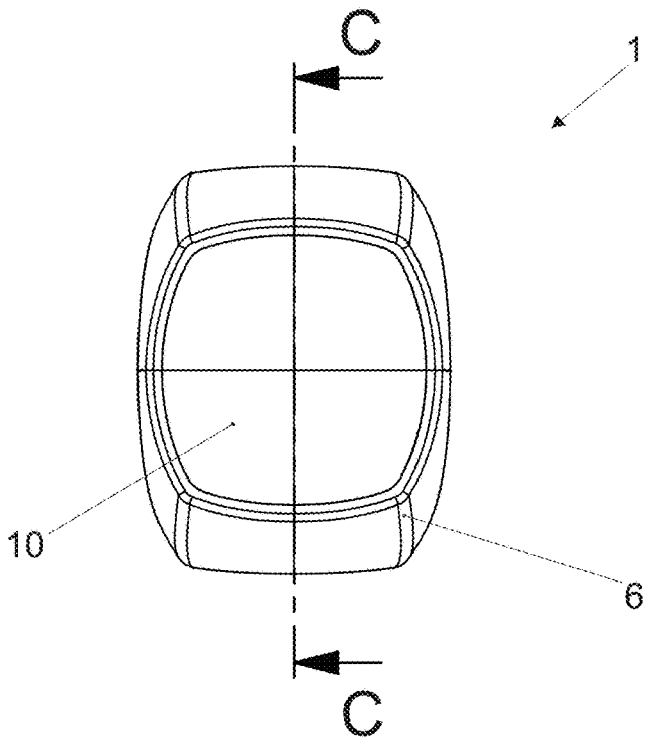
FIG. 15 shows a top view of the embodiment of the ring shown in FIGS. 11, 12, 13 and 14.
Figure 16:
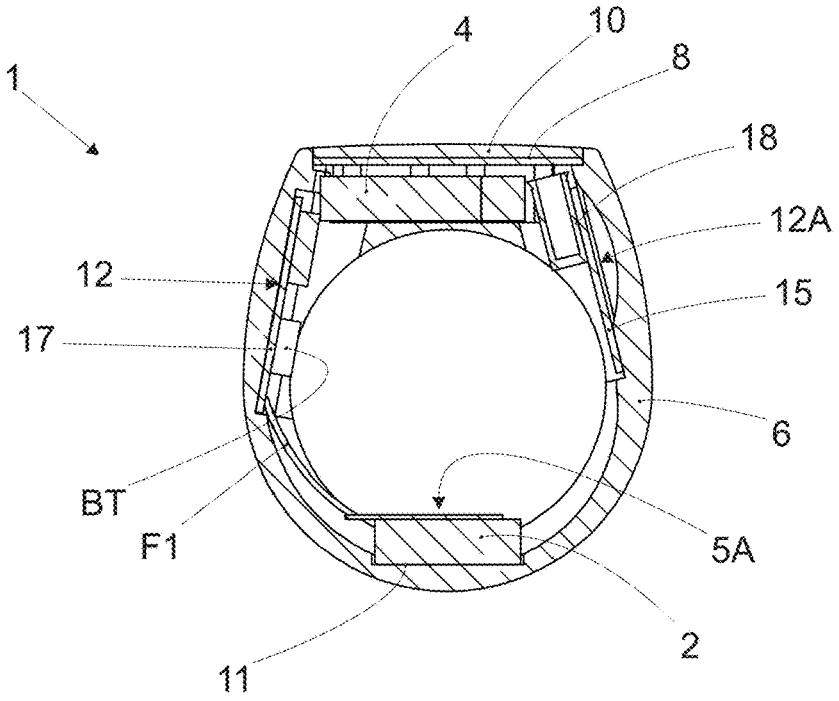
FIG. 16 shows a cross-sectional view of the embodiment of the ring shown in FIGS. 11, 12, 13, 14 and 15, taken in cross-section along the cut line "C"-"C" shown in FIG. 15.
Figure 17:
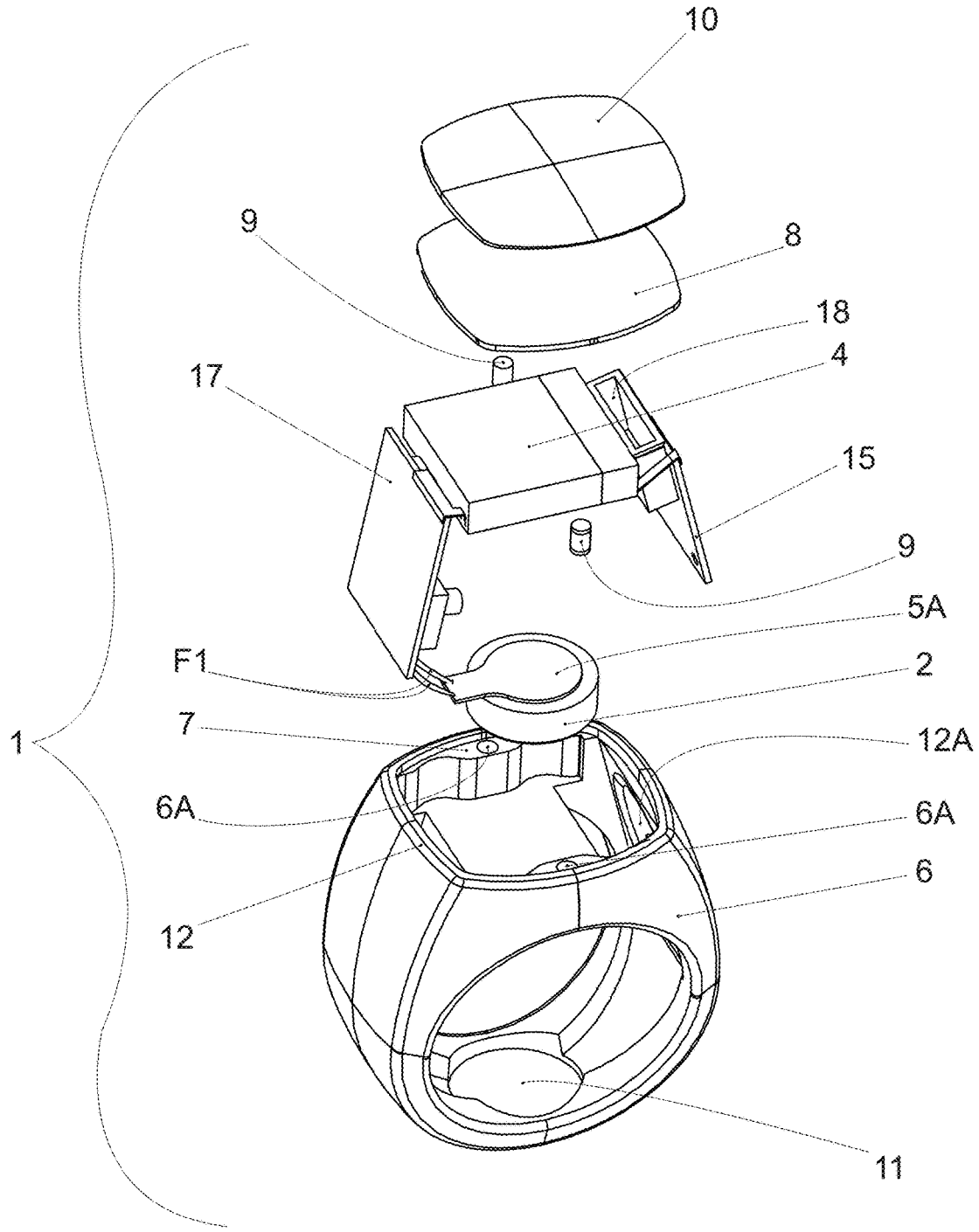
FIG. 17 shows an exploded view of the embodiment of the ring shown in FIGS. 11, 12, 13, 14, 15 and 16 here treated illustrating all of its components separately, but in relative positioning.

By way of example only, the following description shows the prior device model, now belonging to the state of the art, opportunely exposed in order to show more clearly the differences between said previous model and the proposed ring.

The method used by the device described herein is the mechanical vibration, which in this case is produced by an electric motor which performs a vibration at a certain frequency, said motor A miniaturized and encapsulated.

Motor A is powered by an AA-size battery, which is installed in a holder B inside a small plastic housing with removable cover C.

Within the housing, in addition to the battery holder, there is a main switch with on/off function D, which opens or closes the circuit of the device, making it ready for use.

The vibration motor is connected to the main switch and the battery holder via a parallel wire E connecting the motor to the assembly.

The device also has a secondary switch F, of momentary action, i.e., activated only while pushing the button of said switch.

This secondary switch is connected to the assembly (battery holder/main switch/motor) through a second parallel wire G and allows the user to control the period in which the vibration is produced.

The device must be properly installed on the user's body in order to function properly.

Among the possible effects to be realized with the device, the one that stands out is the one that made it known in the national and international market, which is to make a nut to turn on a screw.

The mechanical vibration produced by the vibration motor, in contact with the screw, creates in said screw a movement frequency pattern, fact that causes the rotation of the nut to occur.

As the visual effect occurs without the intervention of physical means perceptible to the observer (or, in this case, spectator), the illusion known to the magicians and/or illusionists as "telekinesis" is created.

The present disclosure in accordance with what is illustrated by the above-mentioned figures, features a ring 1 for performing magic tricks, comprising a miniaturized vibration motor 2, an on/off switch 3 also miniaturized, a power supply element, such as a battery 4, compatible with the electrical characteristics of the motor 2, a metallic contact blade 5, on which the battery 4 is positioned and a printed circuit board 14 which receives the wiring F to interconnect the battery 4 on one side and the motor 2 on the other, closing the circuit.

Thereby, an upper battery 4 is connected via wiring F to a printed circuit board 14 where a switch 3 is provided and, at the bottom, the motor 2 is also connected to this printed circuit board 14 through suitable F1 wiring.

Thus, the ring 1 for performing a magic act has an annular main body 6, in the upper portion of which develops a flat and slightly recessed top face 7, capable of receiving the contact blade 5 connected to the switch 3, a battery 4, a metal plate 8, at least four Neodymium magnet elements 9 and, finally, a closing and adornment stone 10 of the ring.

The Neodymium magnets 9 are attached to the metal plate 8, the attachment base of the adornment stone 10 of the ring 1, and allow easy access to the inside of said ring 1 for a possible replacement of the battery 4 when necessary.

At the lower portion of the ring 1 there is a cavity 11 where the motor 2 is housed and a second contact blade 5A which connects to the switch 3, which is housed in a further cavity 12, positioned laterally said switch 3 whose on/off button 13 is positioned on the outer face of the main body 6 of this ring 1, said switch 3 connected to the contact blade 5A through internal wiring.

In this way, the button 13, the wires of the vibration motor 2 and the wire leading to the metal contact blade 5 on which the battery 4 is positioned are welded to the printed circuit board 14.

The actuator button 13 of the switch 3 is designed outwardly the ring 1 through a small hole 6A, allowing the user to operate the button 13 through the outside of the ring 1, thereby being able to turn the device circuit on and off, thus controlling the period in which the mechanical vibration of the motor 2 is produced.

In this way, with this new ring model 1 for the execution of magic acts, there will be much more practicality, effectiveness and safety in the use of the proposed ring since, in addition to being simpler to operate, this new version of applied device to the ring 1 is lighter and requires less practice on the part of the practitioner or performer of the spell, to realize the possible effects.

FIGS. 11 to 18 show an embodiment of the ring proposed here, which, just as the main model shown in FIGS. 1 to 10 is generally indicated by the reference number 1, being defined by a main body 6, which has its top face 7 slightly recessed.

Ring 1 of the embodiment shown in FIGS. 11 to 18 also comprises an electric vibration motor 2 housed in a cavity 11, assembled in the lower region of the main body 6 of the ring.

The electric vibration motor 2 is powered by a lithium and rechargeable battery 4 which is housed in the upper region of the main body 6 of the ring 1.

The ring 1 also has an adornment stone 10, which is assembled on a metal plate 8, such metal plate 8 being drawn and held in its housing by means of Neodymium magnets 9 which are mounted on 6A accommodation in the main body 6.

The vibrating electric motor 2 is mounted against a contact blade 5A, which, in turn, is connected to a wiring F1, which connects said electric vibration motor 2 to the control circuit board 17.

The main body 6 of the ring 1 in the version shown in FIGS. 11 to 17 comprises two lateral cavities indicated as 12 and 12A.

The ring 1 of the variant shown in FIGS. 11 to 18, in addition to comprise a rechargeable Lithium battery 4, differs from the ring pattern of FIGS. 1 to 10 in that such battery is connected to a recharging circuit board 15, which in turn is connected by a flexible connection circuit 16 to a control circuit board 17.

Figure 18:
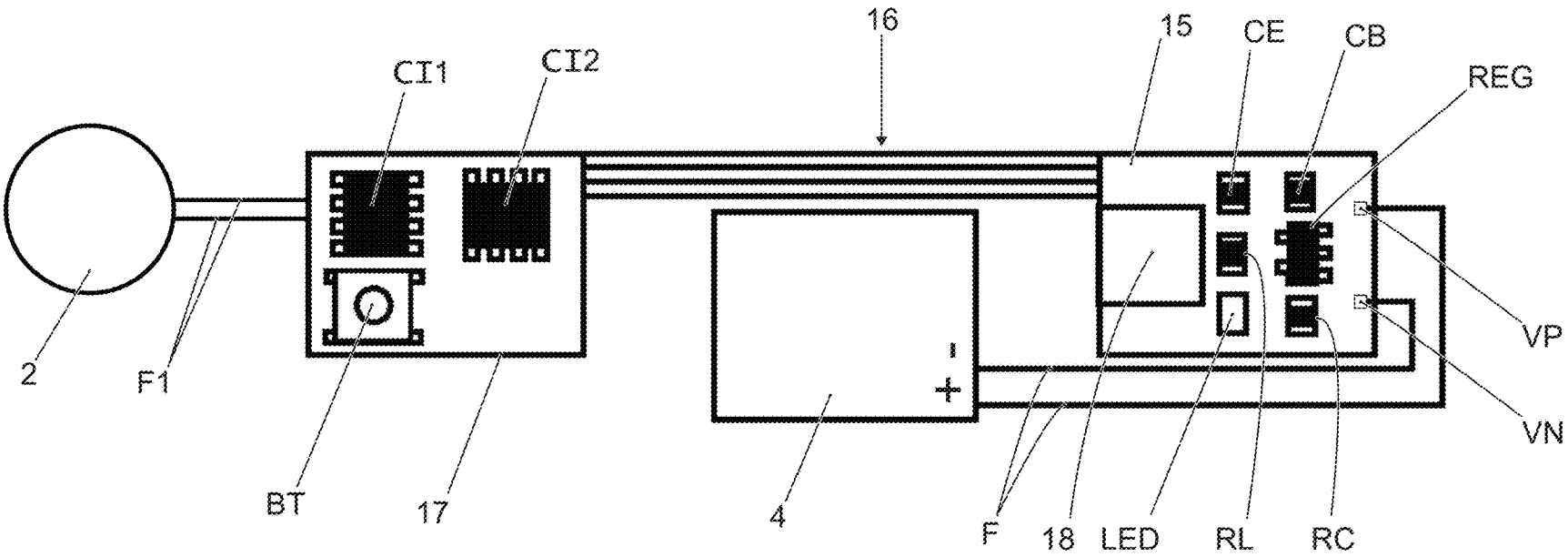
FIG. 18 shows a schematic view of the electronic diagram of the embodiment of the present ring shown in FIGS. 11, 12, 13, 14, 15, 16 and 17.

The recharging circuit board 15, as shown in FIG. 18, comprises a Micro USB 18 input, as well as CE and CB capacitors, RL and RC resistors, plus a recharge indicator LED (LED) and still a REG chip which manages the recharging of the battery 4, said recharging circuit board 15 being connected to the battery 4 by means of wires F which interconnect the negative and positive poles thereof to the respective connections VN and VP of said reference plate recharging circuit board 15.

Still as shown in said FIG. 18, the flexible connection circuit 16 establishes connection between the recharging circuit board 15 to the control circuit board 17, the latter having a CI1, which is a microcontroller responsible for the programming of the control circuit operation; a CI2, which acts as a control driver for reversing the electric vibration motor 2; and a momentary touch switch BT, through which the electric vibration motor 2 can be turned on and off or even has its selected direction of rotation.

The indicated side cavities 12 and 12A respectively serve as housing for the control circuit boards 17 and recharging circuit board 15.

Although the present disclosure is detailed, it is important to understand that it does not limit its application to the details and steps described herein. The disclosure is capable of other embodiments and is practiced or performed in a variety of ways. It should be understood that the terminology employed herein is for the purpose of description and not limitation.

The invention claimed is:

1. A finger ring for performing a magic act, the finger ring comprising:

an annular body with an upper portion that forms a flat and recessed top face and a lower portion that has a first cavity and a second cavity disposed on an inner circumference thereof;

a power supply element and at least four magnet elements disposed in the flat and recessed top face;

a metal plate covering the flat and recessed top face and attached to the at least four magnet elements;

a vibration motor disposed in the first cavity;

a printed circuit board disposed in the second cavity and operable by a switch having an on/off button;

a first contact element in electrical communication with the power supply element and the printed circuit board; and a second contact element in electrical communication with the vibration motor and the printed circuit board.

2. The finger ring according to claim 1, further comprising: a stone disposed over the metal plate.

3. The finger ring according to claim 1, wherein the at least four magnet elements are Neodymium magnets.

4. The finger ring according to claim 1, wherein the second cavity has an opening through the annular body to an outer surface thereof and the switch is disposed in the second cavity so that the on/off button projects from the outer surface of the annular body through the opening.

5. The finger ring according to claim 1, wherein the power supply element is a battery.

6. The finger ring according to claim 5, wherein the battery is a rechargeable lithium battery.

7. The finger ring according to claim 6, further comprising a recharging circuit board disposed in a third cavity on the inner circumference of the annular body, and wherein the printed circuit board is a control circuit board that has a microcontroller and a control driver configured to reverse the vibration motor.

8. The finger ring according to claim 7, wherein the on/off button is a touch switch.

9. The finger ring according to claim 8, wherein the touch switch energizes the vibration motor and selects a rotation direction of the vibration motor.

10. The finger ring according to claim 7, further comprising: a Micro USB input connected on the recharging circuit board.

11. The finger ring according to claim 7, further comprising: an LED recharge indicator connected on the recharging circuit board.

* * * * *